US007802344B2

(12) United States Patent
Watts

(10) Patent No.: US 7,802,344 B2
(45) Date of Patent: Sep. 28, 2010

(54) AFFIXABLE PLASTIC SHIM

(75) Inventor: Edward Watts, Danbury, CT (US)

(73) Assignee: Handi-Shim, LLC, Danbury, CT (US)

( * ) Notice: Subject to any disclaimer, the term of this patent is extended or adjusted under 35 U.S.C. 154(b) by 498 days.

(21) Appl. No.: 11/811,145

(22) Filed: Jun. 8, 2007

(65) Prior Publication Data

US 2007/0286989 A1 Dec. 13, 2007

Related U.S. Application Data

(60) Provisional application No. 60/812,518, filed on Jun. 8, 2006.

(51) Int. Cl.
*E05D 7/04* (2006.01)

(52) U.S. Cl. ..... 16/247; 52/126.1

(58) Field of Classification Search ..... None
See application file for complete search history.

(56) References Cited

U.S. PATENT DOCUMENTS 3,028,657 A * 4/1962 Almen ..... 407/6
4,731,965 A * 3/1988 Jensen ..... 52/126.1
5,160,243 A 11/1992 Herzner et al.
5,320,200 A 6/1994 Hashimoto
5,418,462 A 5/1995 Breneman et al.
5,755,464 A 5/1998 Erwin
5,853,838 A * 12/1998 Siems et al. ..... 428/43
5,923,235 A 7/1999 Van Oort
5,953,862 A * 9/1999 Earhart et al. ..... 52/98
6,079,753 A 6/2000 Erwin
6,254,140 B1 7/2001 Erwin
6,256,858 B1 * 7/2001 Brosilow ..... 29/525.05
6,650,037 B1 11/2003 Reed et al.
6,850,409 B1 2/2005 Triebes et al.
6,923,465 B2 8/2005 DuBuque
7,108,901 B2 9/2006 Traub et al.
7,536,747 B2 * 5/2009 Christeson et al. ..... 16/247
2006/0137140 A1 * 6/2006 Christeson et al. ..... 16/247

* cited by examiner

*Primary Examiner*—Richard E Chilcot, Jr.
*Assistant Examiner*—Alp Akbasli
(74) *Attorney, Agent, or Firm*—Ware, Fressola, Van Der Sluys & Adolphson LLP

(57) ABSTRACT

A plastic shim that has a hole for fixing the shim to a wide variety of objects. The shim may also be breakable for use with smaller applications, while also being usable for larger applications without breaking. In a preferred embodiment, each of the breakable sections has a hole for a screw or nail, so that each of the breakable sections is separately affixable.

17 Claims, 3 Drawing Sheets

200

AFFIXABLE PLASTIC SHIM

CROSS-REFERENCE TO RELATED APPLICATION

The present application claims priority to U.S. Provisional Application 60/812,518 filed Jun. 8, 2006.

BACKGROUND OF THE INVENTION

1. Technical Field

The present invention pertains to the field of hardware tools. More particularly, the present invention pertains to shims.

2. Discussion of Related Art

A shim is a thin, and often tapered or wedged, piece of material. It is used to fill small gaps or spaces between objects. Shims are typically used in order to support, adjust for better fit, or provide a level surface. Shims may also be used as spacers to fill gaps between parts subject to wear. Many materials are suitable shim stock, or base material, depending on the context: wood, stone, plastic, metal, or even paper (e.g., when used under a table leg to level the table surface). High quality shim stock can be bought commercially, for example as laminated shims, but shims are often created ad hoc from whatever material is immediately available.

Attachable shims are known in the art. For example, see U.S. Pat. No. 5,923,235 ("Shim assembly for a pole face of a magnet"); U.S. Pat. No. 6,923,465 ("Heel shim and lifter for ski mountaineering"); U.S. Pat. No. 6,850,409 ("Shim assembly for hardware module"); U.S. Pat. No. 6,650,037 ("Shock absorbing stud shim for a CRT"); U.S. Pat. No. 6,254,140 ("Segmented flange including a shim"); U.S. Pat. No. 6,079,753 ("Segmented flange including a shim"); U.S. Pat. No. 5,755,464 ("Segmented flange structure including a shim"); U.S. Pat. No. 5,418,462 ("Method for determining shim placement on tubular magnet"); U.S. Pat. No. 5,320,200 ("Friction pad with shim for use in disc brake"); U.S. Pat. No. 5,160,243 ("Turbine blade wear protection system with multilayer shim").

It is also known in the art for a shim to have a break line, as in U.S. Pat. No. 7,108,901 ("Shim"). However, such a break line is only known for the purpose of breaking or snapping off material at a desired length of the shim.

Shims, which are sometimes referred to as wedges and tapered work-pieces, can be used in the construction of homes, buildings, furniture and the like, to raise, align, square up and fill gaps of windows, doors and other building components. Traditionally, shims have been formed out of wood and often simply crafted out of scrap pieces of wood. Other attempts at providing a supply of shims include the manufacture of synthetic shims. Such shims tend to be formed primarily from plastic, which is usually more pliable than wood and, thus, more difficult to break or snap off at a desired length. Thus, shims with break lines are uncommon, and not much attention has been paid to them. However, as discussed in the U.S. Pat. No. 7,108,901 ("Shim"), various materials or types of plastic can now be used in a plastic shim in order to enhance its breakability, for example a mixture of plastics and cellulose fiber.

Unfortunately, currently available plastic shims are difficult to attach to other objects. Furthermore, although wood shims could be cut in order to form smaller shims, existing plastic shims are difficult to cut and therefore offer limited options to the consumer, especially if a consumer is in need of attachable shims.

DISCLOSURE OF THE INVENTION

The present invention is a plastic shim that has a countersunk hole for fixing the shim to a wide variety of materials. The old plastic shims of the prior art do not have this type of affixing capability.

The plastic shim of the present invention may also be purposely breakable for use with smaller applications, while also being usable for larger applications without breaking. In a preferred embodiment, each of the breakable sections has a hole for a screw or nail, so that each of the breakable sections is separately affixable, in addition to the unit as a whole being affixable without breaking.

BEST MODE FOR CARRYING OUT THE INVENTION

An embodiment of the present invention will now be detailed with the aid of the accompanying figures. It is to be understood that this embodiment is merely an illustration of one particular implementation of the invention, without in any way foreclosing other embodiments and implementations.

Figure 1:
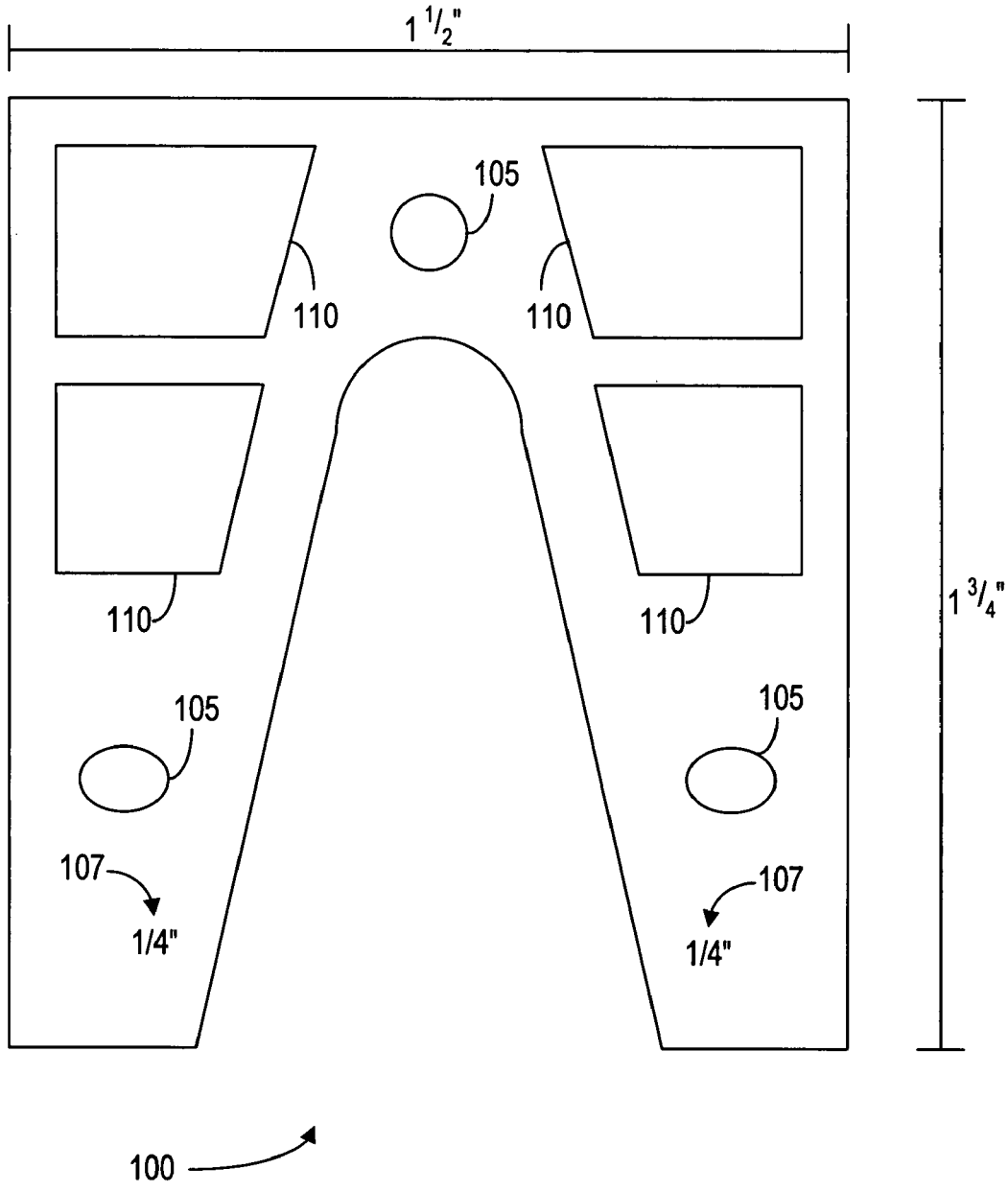
FIG. 1 illustrates an embodiment of the present invention having three holes for screws or nails.

As seen in FIG. 1, the shim 100 has three holes 105 for affixing the shim to another object. Preferably, the shim has its thickness molded 107 onto the shim, as shown. Thus, the plastic shim in FIG. 1 is a quarter inch thick at its lower end, an inch and a half wide, and an inch and three quarters long. The shim also includes empty areas 110 that obviate further plastic material in the shim.

Figure 2:
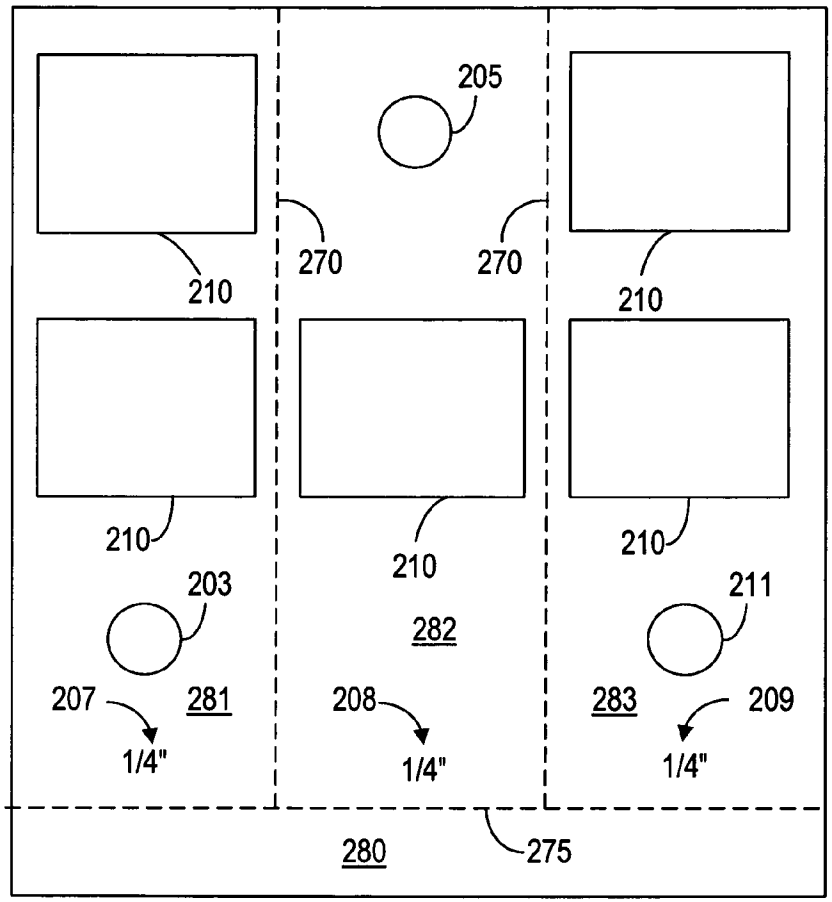
FIG. 2 illustrates an embodiment of the present invention where the shim is breakable into three sections.

As seen in FIG. 2, a plastic shim 200 is breakable along break lines 270 (which may for example be grooves) into three smaller shims 281 and 282 and 283. At least the center shim has a countersunk hole 205 for a screw or nail. It may also be advantageous to include screw holes 203 and 211 in at least one of the other two breakable parts, for example according to the same hole arrangement shown in FIG. 1. This shim 200 can be used in its unitary configuration, or it can be broken into smaller shims along the grooves 270.

In this embodiment shown in FIG. 2, the shim 200 has a substantially uniform width, except for a wedge-shaped part 280 that is connected to the rest of the shim body by break line 275. In this way, the smaller shims can be used as spacers of uniform width. The plastic shim 200 in FIG. 2 is a quarter inch thick (except for the wedge-shaped part), and this is shown three times so that the width will be apparent regardless of whether the shim is broken into smaller shims. Typically, a user will first break off the wedge along break line 275, before breaking along the break lines 270.

Figure 3:
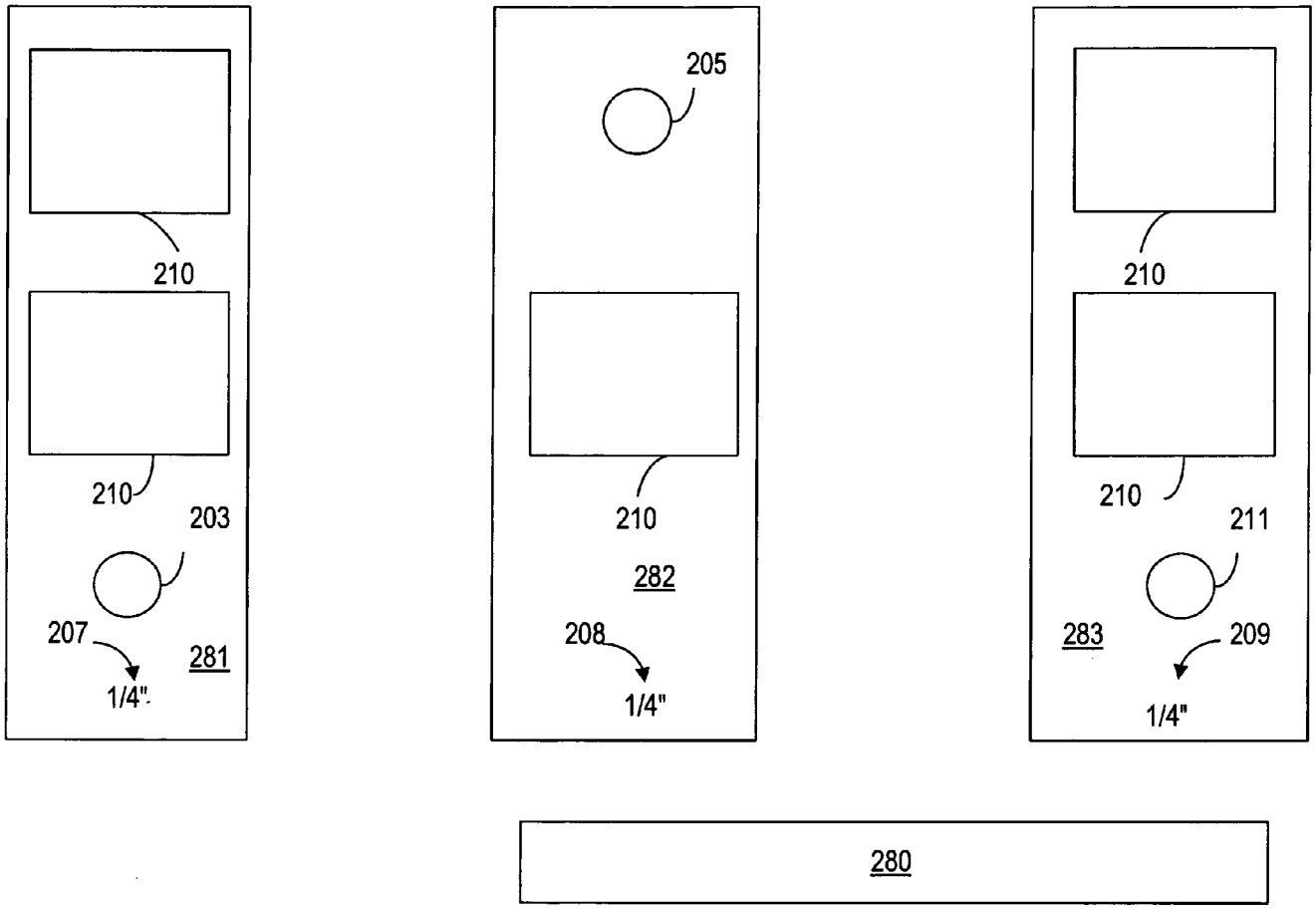
FIG. 3 illustrates the embodiment of FIG. 2, after the shim has been broken into three smaller shims plus a wedge-shaped part.

FIG. 3 shows the embodiment of FIG. 2, after the shim 200 has broken into a set of three separate shims plus the wedge-shaped part. Once the shim 200 has been broken up, the wedge-shaped part 280 can be discarded. Thus, the shim 200 can be used as a unitary shim with wedge, or it can be broken up into three separate shims each having substantially uniform width.

A person skilled in the art will understand that the break lines in the present plastic shim can be formed in a number of different ways, so that the shim will not break unless it is deliberately and forcefully bent along a break line. This ensures that the shim can be used either in its unitary shape, or after breaking it, as the consumer chooses.

Although the figures depict particular embodiments of the invention, a person skilled in the art will understand that the present invention can be implemented in a number of different ways, without departing from the scope and spirit of the invention.

What is claimed is:

1. A shim comprising:

a body having first and second faces, the body being formed at least from a plastic material;

at least one break line formed in the body along the first face, the body being breakable along a first break line of the at least one break line, in order to form a first shim smaller than the body and also at least one further shim smaller than the body;

wherein the body includes at least one hole, wherein the at least one break line and the at least one hole are non- intersecting; and a wedge-shaped part formed in the body along a second break line of the at least one break line, the second break line being substantially perpendicular to the first break line, the body being cleanly breakable along the second break line to separate the wedge-shaped part from the rest of the body.

2. The shim of claim 1, wherein the shim has a thickness molded onto the body.

3. The shim of claim 1, wherein the at least one hole includes a first hole and a second hole, and wherein the first break line passes between the first hole and the second hole.

4. The shim of claim 1, wherein said first break line is configured to join the first smaller shim to the rest of the body unless the body is forcefully bent along the first break line, and wherein the shim is configured for use in either its unitary shape or as a plurality of separate smaller shims.

5. The shim of claim 1, wherein said at least one hole is configured to accept a screw or nail.

6. The shim of claim 1, wherein the body includes at least one empty area in addition to the at least one hole, said at least one empty area obviating an additional amount of the plastic material.

7. The shim of claim 1, wherein said at least one hole is countersunk.

8. The shim of claim 2, wherein said thickness is molded onto the body in at least two locations that are separated by the at least one break line.

9. The shim of claim 1, wherein the body has a substantially uniform thickness, except for the wedge-shaped part.

10. The shim of claim 1, wherein formation of the first shim smaller than the body requires breaking the body along both the first break line and the second break line.

11. The shim of claim 1, wherein the at least one break line comprises a third break line, the body being cleanly breakable along the at least one break line to form at least three shims smaller than the body, and to also separately form the wedge-shaped part.

12. The shim of claim 11, wherein the second break line is substantially perpendicular to the third break line.

13. A shim comprising:

a body having first and second faces, the body being formed at least from a plastic material;

at least one break line formed in the body along the first face, the body being breakable along a first break line of the at least one break line in order to form a first shim smaller than the body and also at least one further shim smaller than the body; and a wedge-shaped part formed in the body along a second break line of the at least one break line, the second break line being substantially perpendicular to the first break line, the body being cleanly breakable along the second break line to separate the wedge-shaped part from the rest of the body.

14. The shim of claim 13, further comprising a third break line for breaking the shim into at least three smaller plastic shims, wherein each of the at least three plastic shims includes one of the at least one round or oval or elliptical border, each of said borders being configured to accept a screw or nail.

15. The shim of claim 13, wherein the shim has a thickness molded onto the body.

16. The shim of claim 13, wherein said first break line is configured to join the first smaller shim to the rest of the body unless the body is forcefully bent along the first break line, and wherein the shim is configured for use in either its unitary shape or as a plurality of separate smaller shims.

17. The shim of claim 13, wherein the body has a substantially uniform thickness, except for the wedge-shaped part.

* * * * *

UNITED STATES PATENT AND TRADEMARK OFFICE

CERTIFICATE OF CORRECTION

PATENT NO. : 7,802,344 B2
APPLICATION NO. : 11/811145
DATED : September 28, 2010
INVENTOR(S) : Edward Watts It is certified that error appears in the above-identified patent and that said Letters Patent is hereby corrected as shown below:

In the Claims:

In column 4 at line 49 (after claim 17), the following claims 18, 19 and 20 should be inserted:

--18. The shim of claim 13, wherein formation of the first shim smaller than the body requires breaking the body along both the first break line and the second break line.

19. The shim of claim 13, wherein the at least one break line comprises a third break line, the body being clearly breakable along the at least one break line to form at least three shims smaller than the body, and to also separately form the wedge-shaped part.

20. The shim of claim 19, wherein the second break line is substantially perpendicular to the third break line.--

Signed and Sealed this
Twenty-fourth Day of July, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,802,344 B2
APPLICATION NO. : 11/811145
DATED : September 28, 2010
INVENTOR(S) : Edward Watts It is certified that error appears in the above-identified patent and that said Letters Patent is hereby corrected as shown below:

Delete the title page and substitute therefore the attached title page showing the corrected number of claims in patent.

In the Claims:

In column 4 at line 49 (after claim 17), the following claims 18, 19 and 20 should be inserted:

--18. The shim of claim 13, wherein formation of the first shim smaller than the body requires breaking the body along both the first break line and the second break line.

19. The shim of claim 13, wherein the at least one break line comprises a third break line, the body being clearly breakable along the at least one break line to form at least three shims smaller than the body, and to also separately form the wedge-shaped part.

20. The shim of claim 19, wherein the second break line is substantially perpendicular to the third break line.--

This certificate supersedes the Certificate of Correction issued July 24, 2012.

Signed and Sealed this
Twenty-eighth Day of August, 2012

David J. Kappos

David J. Kappos
*Director of the United States Patent and Trademark Office*

(12) United States Patent
Watts

(10) Patent No.: US 7,802,344 B2
(45) Date of Patent: Sep. 28, 2010

(54) AFFIXABLE PLASTIC SHIM

(75) Inventor: Edward Watts, Danbury, CT (US)

(73) Assignee: Handi-Shim, LLC, Danbury, CT (US)

( * ) Notice: Subject to any disclaimer, the term of this patent is extended or adjusted under 35 U.S.C. 154(b) by 498 days.

(21) Appl. No.: 11/811,145

(22) Filed: Jun. 8, 2007

(65) Prior Publication Data

US 2007/0286989 A1 Dec. 13, 2007

Related U.S. Application Data

(60) Provisional application No. 60/812,518, filed on Jun. 8, 2006.

(51) Int. Cl.
*E05D 7/04* (2006.01)

(52) U.S. Cl. ..... 16/247; 52/126.1

(58) Field of Classification Search ..... None
See application file for complete search history.

(56) References Cited

U.S. PATENT DOCUMENTS 3,028,657 A * 4/1962 Almen ..... 407/6
4,731,965 A * 3/1988 Jensen ..... 52/126.1
5,160,243 A 11/1992 Herzner et al.
5,320,200 A 6/1994 Hashimoto
5,418,462 A 5/1995 Breneman et al.
5,755,464 A 5/1998 Erwin
5,853,838 A * 12/1998 Siems et al. ..... 428/43
5,923,235 A 7/1999 Van Oort
5,953,862 A * 9/1999 Earhart et al. ..... 52/98
6,079,753 A 6/2000 Erwin
6,254,140 B1 7/2001 Erwin
6,256,858 B1 * 7/2001 Brosilow ..... 29/525.05
6,650,037 B1 11/2003 Reed et al.
6,850,409 B1 2/2005 Triebes et al.
6,923,465 B2 8/2005 DuBuque
7,108,901 B2 9/2006 Traub et al.
7,536,747 B2 * 5/2009 Christeson et al. ..... 16/247
2006/0137140 A1 * 6/2006 Christeson et al. ..... 16/247

* cited by examiner

*Primary Examiner*—Richard E Chilcot, Jr.
*Assistant Examiner*—Alp Akbasli
(74) *Attorney, Agent, or Firm*— Ware, Fressola, Van Der Sluys & Adolphson LLP

(57) ABSTRACT

A plastic shim that has a hole for fixing the shim to a wide variety of objects. The shim may also be breakable for use with smaller applications, while also being usable for larger applications without breaking. In a preferred embodiment, each of the breakable sections has a hole for a screw or nail, so that each of the breakable sections is separately affixable.

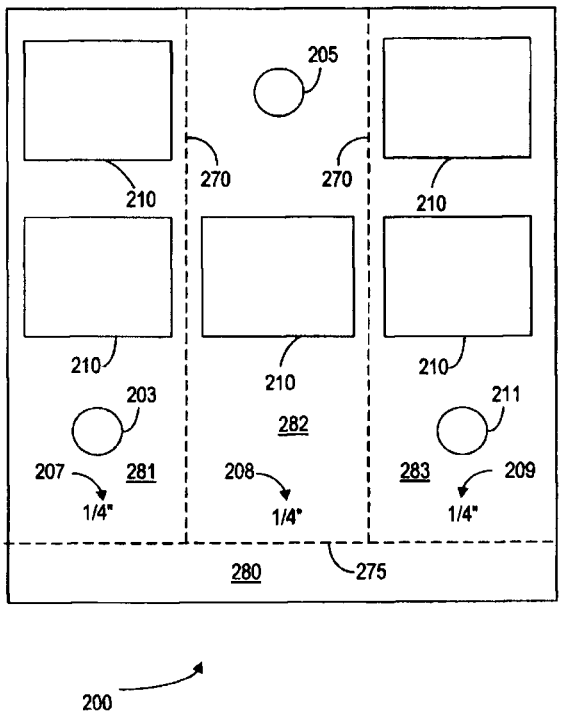

20 Claims, 3 Drawing Sheets